US009957864B2

(12) United States Patent
Johnson et al.

(10) Patent No.: US 9,957,864 B2
(45) **Date of Patent: *May 1, 2018**

(54) SYSTEM AND METHOD FOR SCR INDUCEMENT

(71) Applicants: CUMMINS DISTRIBUTION HOLDCO INC., Columbus, IN (US); CUMMINS POWERGEN IP, INC., Minneapolis, MN (US)

(72) Inventors: Claude M. Johnson, Columbus, IN (US); Eric G. Wiemers, Corona, CA (US)

(73) Assignees: Cummins Distribution Holdco Inc., Columbus, IN (US); Cummins PowerGen IP, Inc., Minneapolis, MN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/324,729

(22) Filed: Jul. 7, 2014

(65) Prior Publication Data

US 2014/0318104 A1 Oct. 30, 2014

Related U.S. Application Data

(63) Continuation of application No. 13/705,860, filed on Dec. 5, 2012, now Pat. No. 8,806,853.

(51) Int. Cl.
*F01N 3/00* (2006.01)
*F01N 3/18* (2006.01)
(Continued)

(52) U.S. Cl.
CPC ..... *F01N 3/18* (2013.01); *F01N 3/2073* (2013.01); *F02D 17/04* (2013.01); *F02D 41/042* (2013.01); *F02D 2041/228* (2013.01)

(58) Field of Classification Search
CPC .... F01N 13/02; F01N 2550/02; F01N 11/007; F01N 3/0842; F01N 2610/02; F01N 3/208; F02D 41/1441
(Continued)

(56) References Cited

U.S. PATENT DOCUMENTS 4,243,893 A 1/1981 Sten
4,608,946 A 9/1986 Tanaka et al.
(Continued)

FOREIGN PATENT DOCUMENTS

EP 1612916 1/2006
EP 1978241 10/2008
JP 6501760 2/1994

OTHER PUBLICATIONS

"Control of Emissions of Air Pollution from Nonroad Diesel Engines and Fuel," Environmental Protection Agency, Federal Register, vol. 69, No. 124, Jun. 29, 2004, 316 pages.
(Continued)

*Primary Examiner* — Jason Shanske
(74) *Attorney, Agent, or Firm* — Faegre Baker Daniels LLP

(57) ABSTRACT

A system and method of inducing proper operation of a diesel engine exhaust after-treatment system employing SCR technology monitors components to detect a fault condition representing one of a DEF level fault, a DEF quality fault, and a tampering fault, activates a trigger event indicator in response to detecting the fault condition. The trigger event indicator provides an indicium to an operator of the presence of the fault condition. The system and method also activates an inducement event indicator in response to activating the trigger event indicator. The inducement event indicator provides an indicium to the operator that the engine will be shut down if the fault condition is not addressed within a predetermined time
(Continued)

period. The system and method causes shutdown of the engine when the fault condition is not addressed within the predetermined time period.

22 Claims, 11 Drawing Sheets

(51) Int. Cl.
*F01N 3/20* (2006.01)
*F02D 17/04* (2006.01)
*F02D 41/04* (2006.01)
*F02D 41/22* (2006.01)

(58) Field of Classification Search
USPC ..... 60/274
See application file for complete search history.

(56) References Cited

U.S. PATENT DOCUMENTS 4,733,750 A 3/1988 Poirier et al.
4,835,405 A 5/1989 Clancey et al.
4,907,546 A 3/1990 Ishii et al.
5,694,889 A 12/1997 Ball et al.
6,028,369 A 2/2000 Hirose et al.
6,450,133 B1 9/2002 Bernard et al.
6,630,756 B2 10/2003 Kern et al.
6,784,574 B2 8/2004 Turner et al.
6,865,883 B2 3/2005 Gomulka
6,895,903 B2 5/2005 Campion
7,007,966 B2 3/2006 Campion
7,314,397 B2 1/2008 Sodemann et al.
7,467,749 B2 12/2008 Tarabulski et al.
7,482,705 B2 1/2009 Piercey, III
8,146,349 B2 4/2012 Bioms et al.
8,196,555 B2 6/2012 Ideda et al.
8,459,216 B2 6/2013 Kiejeski et al.
2006/0080971 A1 4/2006 Smith et al.
2007/0132243 A1 6/2007 Wurtele et al.
2008/0129053 A1 6/2008 Piercey
2008/0311010 A1 12/2008 Boe
2009/0044524 A1 2/2009 Fujino
2010/0005791 A1 1/2010 Ranganathan et al.
2010/0023200 A1* 1/2010 Kurrle et al. ..... 701/29
2010/0071351 A1* 3/2010 Nishimura et al. ..... 60/286
2010/0186373 A1 7/2010 Pierz et al.
2010/0312445 A1* 12/2010 Bogema et al. ..... 701/70
2011/0107812 A1* 5/2011 Kasahara ..... 73/1.02
2011/0214415 A1 9/2011 Thomas
2011/0214643 A1 9/2011 Blizard et al.
2011/0232611 A1* 9/2011 Shaikh et al. ..... 123/520
2011/0248511 A1 10/2011 Marlenee et al.
2012/0003131 A1 1/2012 Ibrahim et al.
2012/0121475 A1 5/2012 van Niekerk
2012/0160934 A1 6/2012 Ponnathpur et al.
2012/0180457 A1 7/2012 Liu et al.
2012/0204542 A1 8/2012 Norris et al.
2013/0213013 A1 8/2013 Mitchell et al.
2013/0333355 A1 12/2013 Lee et al.

OTHER PUBLICATIONS

40 CFR Chapter 1 (Jul. 1, 2012 Edition), Part 1039—Control of Emissions from New and In-Use Nonroad Compression-Ignition Engines, 80 pages.
"Tier 4 Regulations Affect More Than Engines," Jun. 6, 2011, downloaded from http://www.power-eng.com/articles/pring/volume-115/issue-6/features/tier-4-regulations-af.

* cited by examiner

SYSTEM AND METHOD FOR SCR INDUCEMENT

RELATED APPLICATIONS

The present application is a continuation of and claims priority to application Ser. No. 13/705,860, titled "SYSTEM AND METHOD FOR SCR INDUCEMENT," filed Dec. 5, 2012, the entire disclosure of which being hereby expressly incorporated herein by reference.

TECHNICAL FIELD

The present invention relates to diesel engine exhaust after-treatment systems and methods for reducing emissions. More specifically, the invention relates to systems and methods for inducing operator correction of faults relating to operation of SCR technology in the after-treatment process.

BACKGROUND

Diesel engines produce various undesirable combustion byproducts including nitrogen oxides (NOx) and particulate matter (PM). As these byproducts have a negative effect on the environment, the Environmental Protection Agency (EPA) has imposed various regulations over the years designed to reduce their emission. These regulations apply to off-road diesel engines and stationary engines. Recently, the EPA graduated its emissions regulations for large stationary generator (genset) systems to the Tier 4 Interim (Tier 4i) requirement, which will be followed in 2015 by the even more stringent Tier 4 Final (Tier 4F) requirement. One technology for treating the exhaust stream from diesel engines in a system designed to meet these requirements is Selective Catalytic Reduction (SCR).

SCR is an after-treatment technology designed to permit NOx reduction reactions to take place in an oxidizing atmosphere, thereby chemically washing out the NOx from the exhaust before the exhaust is released into the environment. In general, an automotive grade urea-based solution (called diesel exhaust fluid (DEF) in North America) is injected into the exhaust upstream of a catalyst. The DEF decomposes to form ammonia (NH3) which, with the SCR catalyst, reacts with the NOx and converts it into nitrogen, water, and small amounts of carbon dioxide (CO2), all natural components of air.

As indicated above, SCR technology is an after-treatment process. If the SCR system is not functioning properly, unacceptable emission levels will result as the engine continues to produce NOx. Thus, while the technology is effective, it is only as effective as the approach implemented for maintaining optimum operation. One challenge to ensuring an SCR system continuously functions as intended is addressing the need to maintain the DEF supply at an acceptable level. Engine maintenance personnel need to be alerted when DEF supplies are low so they can take action to refill the DEF tank. Moreover, in some instances engine operators intentionally substitute DEF with a watered down version (or even pure water) to reduce costs. Unless a sufficiently high quality DEF is used, the NOx removal function of the SCR system is degraded or even eliminated, and the result is excessively high emissions. Additionally, engine operators may attempt to tamper with or skip required maintenance on certain components of the after-treatment system and thus override emission reduction and safety functions. Consequently, the EPA has issued guidelines requiring strategies for inducing engine operators to maintain proper function of the Tier 4 after-treatment system, such as maintaining the proper DEF supplies necessary to keep the SCR systems functional and to refrain from intentional tampering.

SUMMARY

In one embodiment, the present disclosure provider a method of inducing proper operation of a diesel engine exhaust after-treatment system of a genset employing SCR technology, including the steps of monitoring the system to detect a first fault condition representing one of a DEF level fault, a DEF quality fault, and a tampering fault, activating a trigger event indicator in response to detecting the first fault condition, the trigger event indicator providing an indicium to an operator of the presence of the first fault condition, activating an inducement event indicator in response to activating the trigger event indicator, the inducement event indicator providing an indicium to the operator that the engine will be shut down if the first fault condition is not addressed within a first predetermined time period, shutting down the engine when the first fault condition is not addressed within the first predetermined time period, initiating a repeat offense timer which increments through a predetermined repeat offense time period, reactivating the inducement event indicator in response to detecting the first fault condition for a second time during the repeat offense time period, the reactivated inducement event indicator providing an indicium to the operator that the engine will be shut down if the first fault condition is not addressed within a second predetermined time period which is less than the first predetermined time period, and shutting down the engine when the first fault condition is not addressed within the second predetermined time period.

In another embodiment, the present disclosure provides an SCR exhaust after-treatment system for a diesel engine of a genset, the system configured to induce compliance with emissions regulations and including a level sensor positioned in a DEF tank to detect a level of DEF in the tank, and a controller coupled to the level sensor to receive signals representing a level of DEF in the tank, the controller including a plurality of trigger event indicators, an inducement event indicator, and a communication link coupled to an ECU configured to control operation of the engine. In this embodiment, in response to receipt of a first signal from the level sensor representing a first level of DEF in the tank, the controller sets a DEF level fault, activates a first trigger event indicator, and activates the inducement event indicator to provide a first indicium to an operator of an impending engine shutdown and in response receipt of a second signal from the level sensor representing a second level of DEF in the tank, the second level being lower than the first level, the controller activates the inducement event indicator to provide a second indicium to an operator of an impending engine shutdown, the second indicium being different from the first indicium.

In yet another embodiment, the present disclosure provides an SCR exhaust after-treatment system for a diesel engine of a generator, the system configured to induce compliance with emissions regulations and including an inlet NOx sensor in communication with an inlet exhaust stream from the engine and configured to provide an inlet NOx signal indicating a level of inlet NOx in the inlet exhaust stream, a DEF injector assembly in communication with the inlet exhaust stream for injecting DEF into the inlet exhaust stream thereby creating a dosed exhaust stream, an SCR portion downstream from the DEF injector assembly configured to convert the dosed exhaust stream into an outlet exhaust stream having reduced NOx, an outlet NOx sensor in communication with the outlet exhaust stream and configured to provide an outlet NOx signal indicating a level of outlet NOx in the outlet exhaust stream, and a controller coupled to the inlet NOx sensor to receive the inlet NOx signal and the outlet NOx sensor to receive the outlet NOx signal, the controller including a plurality of trigger event indicators, an inducement event indicator, a timer, and a communication link coupled to an ECU configured to control operation of the engine. In this embodiment, the controller provides a final dosing command to the DEF injector assembly to control injection of DEF into the inlet exhaust stream, the final dosing command being a combination of an initial dosing command based on the inlet NOx signal, and a dosing trim command based on the outlet NOx signal. Additionally, in response to the dosing trim command exceeding a predetermined threshold, the controller sets a DEF quality fault and activates a first trigger event indicator, and in response an outlet NOx signal indicating the level of outlet NOx exceeds a predetermined limit while the first trigger event indicator is active, the controller activates a second trigger event indicator representing a NOx out-of-limits fault, activates the inducement event indicator to provide a first indicium to an operator of an impending engine shutdown, and activates the timer to begin incrementing through a first predetermined time period. If at least one of the DEF quality fault and the NOx out-of-limits fault is not cleared during the first predetermined time period, then the controller sends a shutdown command to the ECU which causes the ECU to shut down the engine.

In still a further embodiment, the present disclosure provides an SCR exhaust after-treatment system for a diesel engine, the system configured to induce compliance with emissions regulations and including a level sensor positioned within a DEF tank and configured to provide output signals representing a level of DEF within the tank, the output signals having expected characteristics, an outlet NOx sensor positioned at an outlet of the system and configured to provide output signals representing a level of NOx in exhaust at the outlet, the output signals having expected characteristics, and a controller coupled to the level sensor and the outlet NOx sensor to receive the output signals, the controller including a plurality of trigger event indicators, an inducement event indicator, a timer, and a communication link coupled to an ECU configured to control operation of the engine. In this embodiment, in response to receipt of an output signal not having an expected characteristic, the controller sets a tampering fault indicating that the level sensor has been tampered with, activates a first trigger event indicator, activates the inducement event indicator to provide a first indicium to an operator of an impending engine shutdown, and activates the timer to begin incrementing through a first predetermined time period, and if the tampering fault is not cleared during the first predetermined time period, then the controller sends a shutdown command to the ECU which causes the ECU to shut down the engine.

In another embodiment, the present disclosure provides an SCR exhaust after-treatment system for a diesel engine of a genset, the system configured to induce compliance with emissions regulations and including a plurality of sensors configured to provide output signals representing operational parameters of the system, the output signals having expected characteristics, an outlet NOx sensor positioned at an outlet of the system and configured to provide output signals representing a level of NOx in exhaust at the outlet, and a controller coupled to the plurality of sensors and the outlet NOx sensor to receive the output signals, the controller including a plurality of trigger event indicators, an inducement event indicator, a timer, and a communication link coupled to an ECU configured to control operation of the engine. In this embodiment, in response to receipt from a first sensor of the plurality of sensors of an output signal not having an expected characteristic and receipt of an output signal from the outlet NOx sensor representing a level of NOx that is out-of-limits, the controller sets a tampering fault, activates a first trigger event indicator, sets a NOx out-of-limits fault, activates a second trigger event indicator, activates the inducement event indicator to provide a first indicium to an operator of an impending engine shutdown, and activates the timer to begin incrementing through a first predetermined time period, and if at least one of the tampering fault and the NOx out-of-limits fault is not cleared during the first predetermined time period, then the controller sends a shutdown command to the ECU which causes the ECU to shut down the engine.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
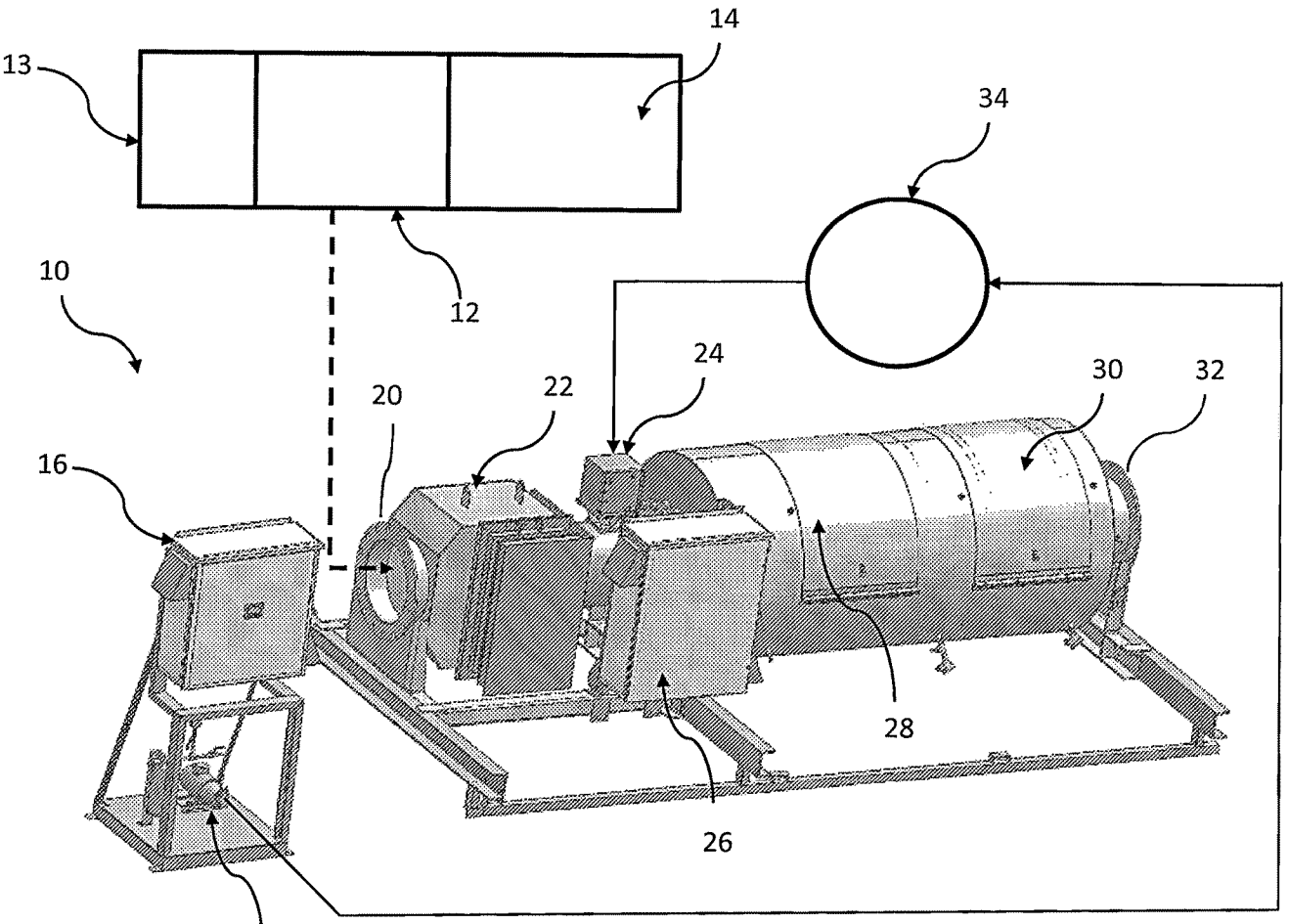
FIG. 1 is a perspective view of an exhaust after-treatment system.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 6:
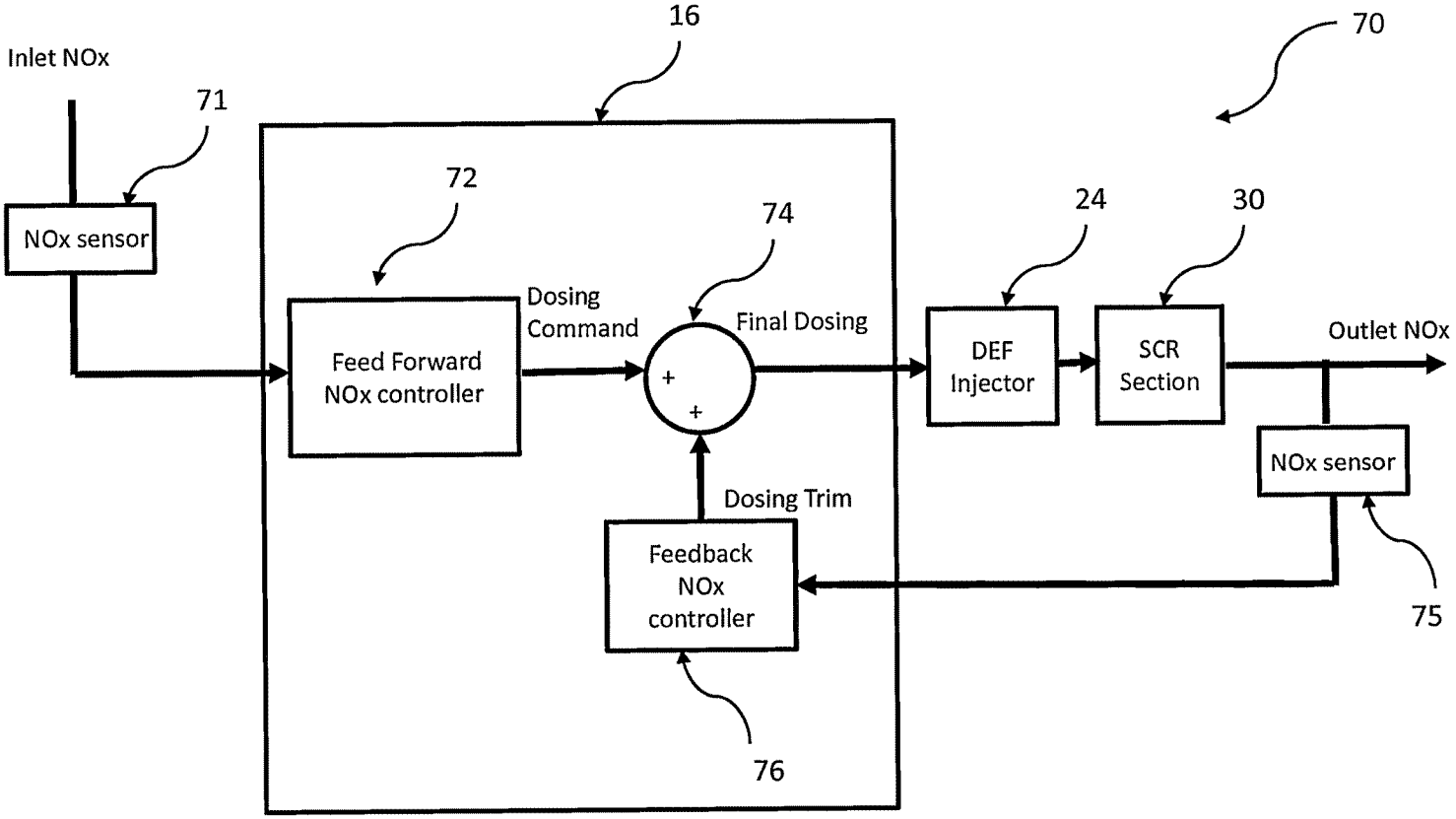
FIG. 6 is a block diagram of a DEF diagnostic loop according to the present disclosure.

FIG. 1 depicts an after-treatment system 10 configured for operation with a diesel engine 12, controlled by an engine/generator control unit (ECU) 13, and used to power a generator 14 for generating electricity. System 10 generally includes an after-treatment controller 16, a DEF pump 18, an exhaust inlet 20, an exhaust heater 22, a DEF injector 24, an exhaust heater power panel 26, a diesel particulate filter (DPF) section 28, an SCR section 30, an exhaust outlet 32 and a DEF tank 34 which is connected to DEF pump 18 and DEF injector 24. As shown in FIG. 6, system 10 further includes inlet NOx sensor 71 (positioned within exhaust inlet 20) and outlet NOx sensor 75 (positioned within exhaust outlet 32). As suggested in FIG. 1, exhaust generated by engine 12 is routed (as indicated by dashed line 34) to exhaust inlet 20. The exhaust is heated by heater 22, and DEF is injected into the exhaust stream by DEF injector 24 in a manner more fully described in the co-pending and co-owned patent application entitled DIESEL EXHAUST FLUID INJECTOR ASSEMBLY, the disclosure of which is expressly incorporated herein by reference. The exhaust then passes through DPF section 28, which removes particulate matter or soot from the exhaust stream. Finally, the exhaust passes through SCR section 30 which converts the NOx in the exhaust to harmless air components in the manner described above. It is noted that in various embodiments of the present invention one or more of the elements listed in the system 10 of FIG. 1 may be omitted or additional elements added.

Figure 2:
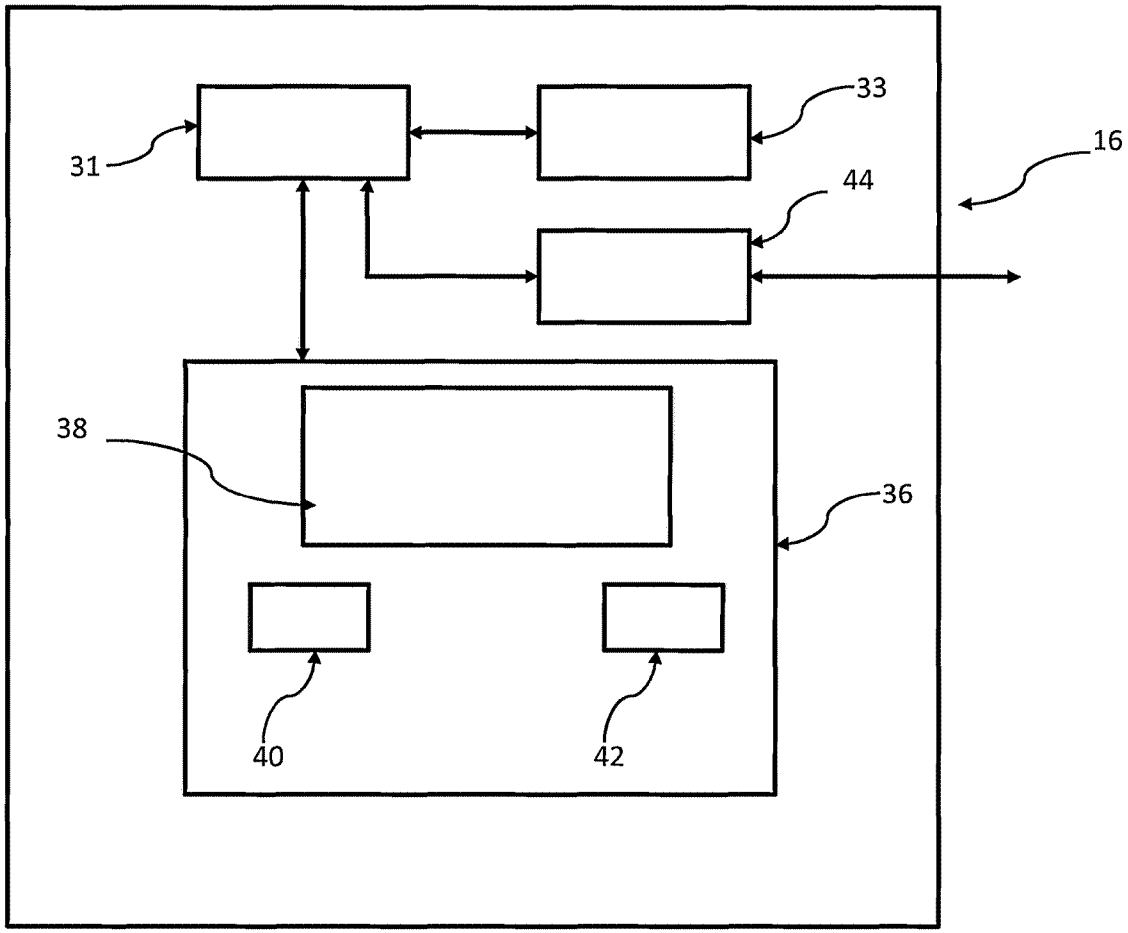
FIG. 2 is a conceptual diagram of a controller according to the present disclosure.

In the process of treating exhaust in the manner generally described above, controller 16 communicates with a variety of components of system 10 such as DEF injector 24, a sensor (described below) used to detect the level of DEF in DEF tank 34, ECU 13, which may communicate with external systems associated with a power grid, and various other components such as pressure and temperature sensors as described herein. In general, controller 16 is a computing, control and communication device that may be implemented in a variety of different configurations as will be appreciated by those skilled in the art. As shown in FIG. 2, controller 16 generally includes one or more processors 31, one or more memory devices 33 in communication with processor 31 and configured to store data and instructions for execution by processor 31 to perform the functions described herein. Controller 16 further includes an annunciator panel 36 having a display 38, one or more visual indicators 40, and one or more audio alarms 42. Controller 16 also includes one or more communication links 44 which permits controller 16 to communicate either wired or wirelessly with the various components of system 10 described above. In one embodiment, controller 16 monitors system 10 for fault conditions which trigger the EPA required SCR inducement events for Tier 4 compliant gensets. The fault conditions generally fall into one of three categories: DEF level, DEF quality and system fault or tampering, as is further described below.

Figure 3:
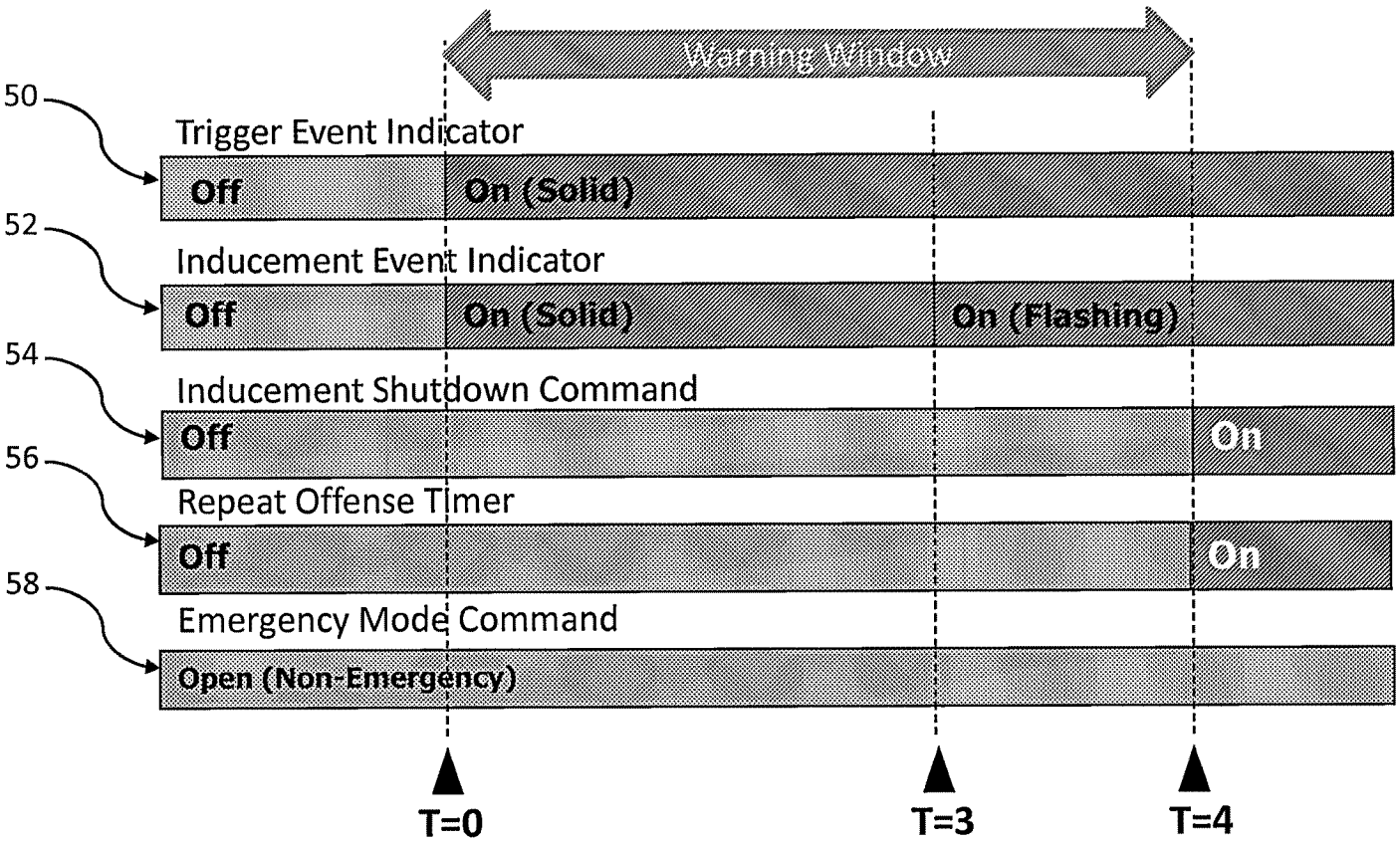
FIG. 3 is a timeline of a general inducement sequence according to the present disclosure.

FIG. 3 depicts a generic timeline for an SCR inducement sequence according to the present disclosure. The status of a fault condition or trigger event indicator 50 is represented by the upper bar in FIG. 3. The remaining bars represent the status of an inducement event indicator 52, an inducement shutdown command 54, a repeat offense timer 56, and an emergency mode command 58. In general, before time T=0 no trigger event (described below) has been detected by controller 16 and no emergency mode command 58 has been received. At time T=0, a trigger event is detected (i.e., controller 16 has detected a DEF level fault, a DEF quality fault or a system/tampering fault). Accordingly, at time T=0 the status of a fault event indicator 50 transitions from off to on. In one embodiment, trigger event indicator 50 is provided to one or more operators of engine 12 as a fault message displayed on controller 16 display 38, the activation of a visual indicator 40, and/or the activation of an audio alarm 42. Trigger event indicator 50 may also be communicated to engine operators via communication link 44 through a network such as a telephone network or the internet in the form of a pager alert, text message, email message or other suitable mode of communication enabled by controller 16.

Also at time T=0, the status of the inducement event indicator 52 transitions from off to on. In one embodiment, inducement event indicator 52 is provided to one or more operators of engine 12 as a fault message displayed on controller 16 display 38, the activation of a visual indicator 40, and/or the activation of an audio alarm 42. Like trigger event indicator 50, inducement event indicator 52 may also be communicated to engine operators via a network such as a telephone network or the internet in the form of a pager alert, text message, email message or other suitable mode of communication enabled by controller 16. Initially, inducement event indicator 52, if provided in visual form, is provided in one embodiment as a solid display (e.g., a non-changing icon or a continuously lit indicator). This first indicium informs the operator that an inducement event is pending and provides the operator the ability to address the fault condition and clear the trigger event.

When inducement event indicator 52 transitions to solid on, controller 16 initiates a timer which delays the execution of an inducement shutdown (described below) for a predetermined period of time to permit the operator to address the fault condition. In one embodiment, the predetermined time period or warning window is four hours. As indicated on FIG. 3, at time T=3 the status of inducement event indicator 52 is transitioned from solid on to flashing. Time T=3 may be specified as occurring a predetermined time (e.g., three hours) following time T=0. Alternatively, time T=3 may correspond to a particular level of DEF in DEF tank 34 as described below, or level or status of another element of the after-treatment system 10. This second indicium of inducement event indicator 52 informs the operator that a shutdown is imminent if the fault condition is not cleared. It should be understood that other techniques for communicating the more urgent status of inducement event indicator 52 such as activating an indicator 40 of a different color at time T=3 or activating an audio alarm 42, are within the scope of the present disclosure.

At time T=4, the status of the inducement shutdown command 54 transitions from off to on if the fault condition is not cleared or an emergency operation mode entered for the genset. This indicates the initiation of a shutdown sequence wherein controller 16 communicates with ECU 13 to cause ECU 13 to disable engine 12, thereby preventing unacceptable levels of pollutant emissions. In other words, if the fault condition persists beyond the warning window, then controller 16 causes a shutdown of engine 12 to prevent continued, improper operation of system 10.

Also at time T=4, repeat offense timer 56 is initiated by controller 16. The repeat offense timer runs for a predetermined period of time (e.g., 40 hours) and controller 16 monitors system 10 during this time to determine whether the same fault condition that activated repeat offense timer 56 occurs again. If so, then controller 16 skips the above sequence and takes repeat offense action in the manner described below.

Figure 4:
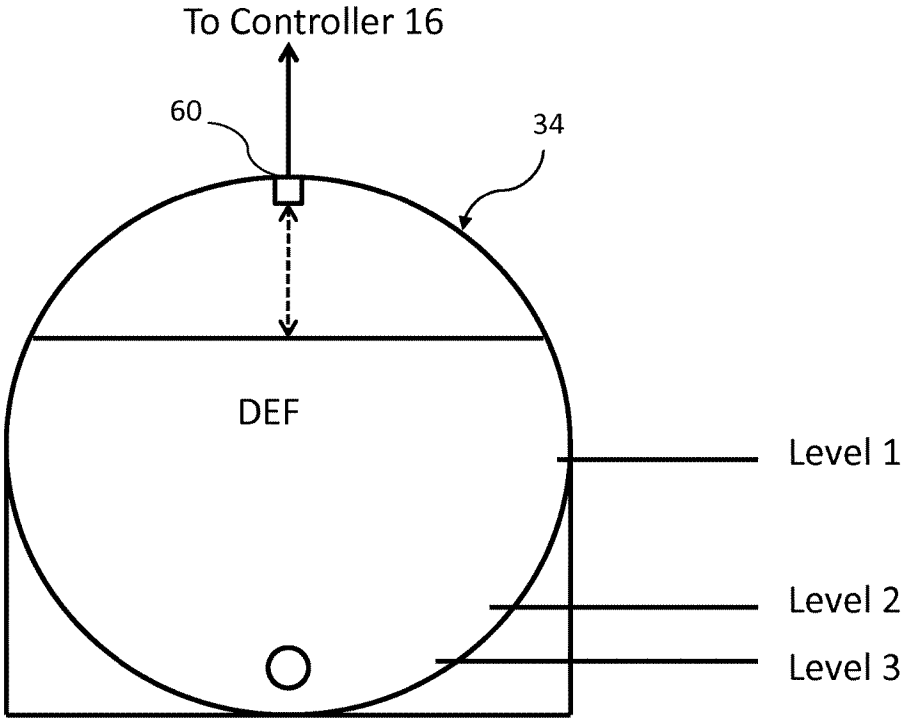
FIG. 4 is a conceptual diagram of a DEF tank.
Figure 5:
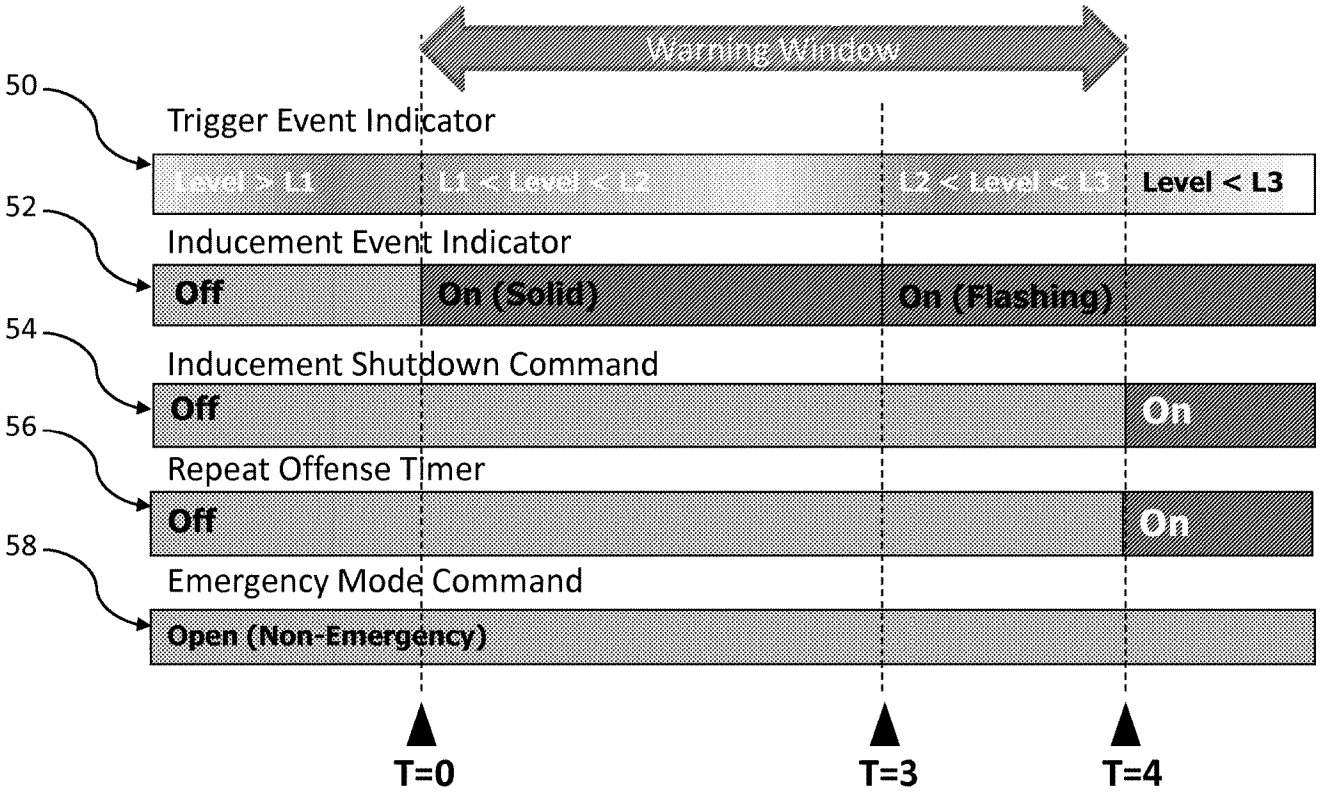
FIG. 5 is a timeline of a DEF level inducement sequence according to the present disclosure.

Referring now to FIGS. 4 and 5, a DEF level trigger event and the subsequent inducement sequence is described. FIG. 4 depicts DEF tank 34 of FIG. 1 with predetermined level thresholds indicated. As described above, system 10 cannot function to remove NOx without injecting DEF into the exhaust stream. Accordingly, it is necessary to monitor the level of DEF in DEF tank 34 to ensure that a sufficient quantity of DEF is available for continued use of system 10. DEF tank 34 includes a level sensor 60 positioned within tank 34 to detect the level of DEF. Any of a plurality of suitable level sensing technologies may be used such as optical sensors, float sensors, and even multiple mechanical sensors positioned at specified levels in tank 34. In one embodiment, level sensor 60 is an ultrasonic sensor that emits sound waves toward the DEF, receives return signals reflected off the surface of the DEF, and computes the time required to receive the return signals. In this embodiment, level sensor 60 provides a signal to controller 16 representing the level of DEF in tank 34 (in terms of time or distance), and controller 16 compares the signal to the predetermined level thresholds (levels 1-3) to determine whether a DEF level fault should be set.

In one embodiment, level 1 corresponds to a volume of DEF in DEF tank 34 necessary to operate system 10 for a predetermined time period at a maximum DEF dosing rate before reaching the minimum tank volume to enable dosing. In one embodiment, the predetermined time period is four hours. Level 2 corresponds to a volume of DEF in DEF tank 34 necessary to operate system 10 for another, smaller predetermined time period at a maximum DEF dosing rate before reaching the minimum tank volume to enable dosing. In one embodiment, the smaller predetermined time period is one hour. Finally, level 3 corresponds to the minimum volume of DEF in DEF tank 34 to enable dosing. In other words, if the DEF level in DEF tank 34 is permitted to fall below level 3, then system 10 will not be able to inject DEF into the exhaust stream of engine 12, and unacceptable levels of emissions will result.

Referring now to FIG. 5, in this example the trigger event considered is the level of DEF in DEF tank 34 as detected by controller 16. Specifically, before time T=0 the DEF level indicated by the signal from level sensor 60 is above level 1 and therefore trigger event indicator 50 is off. When the DEF level falls below level 1, controller 16 causes trigger event indicator 50 to transition to on as described above with reference to FIG. 3. Additionally, inducement event indicator 52 transitions to solid on as also described above. In this example, the DEF level falls below level 2 at time T=3. Sensor 60 sends a corresponding signal to controller 16 causing inducement event indicator 52 to transition from solid on to flashing as described above. At time T=4, the DEF level falls below level 3, and controller 16 generates an inducement shutdown command 54 and initiates repeat offense timer 56 in the manner described above. As a consequence of inducement shutdown command 54, engine 12 is disabled.

Another trigger event monitored by system 10 is the quality of the DEF injected into the exhaust stream. In one embodiment, the system 10, includes a DEF quality sensor to test the DEF and assure it is of appropriate quality. In another embodiment, DEF quality is monitored in a "sensorless" manner utilizing the NOx control loop and NOx sensors. FIG. 6 provides a block diagram representation of a DEF injection control loop capable of diagnostic testing of the DEF used in system 10 and implemented in controller 16. More specifically, DEF control loop 70 includes inlet NOx sensor 71, a feed forward NOx controller 72, a summing junction 74, DEF injector 24, SCR section 30, an outlet NOx sensor 75, and a feedback NOx controller 76. Feed forward controller 72 determines the level of NOx in the inlet exhaust stream based on signals from inlet NOx sensor 71. Based upon the detected inlet NOx level and a predetermined standard DEF concentration, feed forward controller 72 generates a DEF dosing command for DEF injector 24. At summing junction 74, the DEF dosing command is added to a dosing trim command (described below) to result in the final dosing command for DEF injector 24. The dosed exhaust eventually passes through SCR section 30 of system 10. Outlet NOx sensor 75 is positioned in the outlet exhaust stream to detect the level of outlet NOx from SCR section 30. The outlet NOx level is detected by feedback controller 76 based on signals from outlet NOx sensor 75. Based on the level of outlet NOx, feedback controller 76 provides the dosing trim command to summing junction 74. If the outlet NOx level is too high, additional DEF is injected into the exhaust as a result of the dosing trim command. In this manner, the final dosing command provided to DEF injector 24 is adjusted to maintain the outlet NOx below a predetermined acceptable level.

Controller 16 monitors the dosing trim command from feedback controller 76 to determine whether it exceeds a predetermined threshold which, if exceeded, indicates that an excessively large trim dose of DEF is necessary to maintain the outlet NOx below the acceptable level. This condition indicates that the dosing command from feed forward controller 72 is too low, which in turn indicates that the DEF concentration is below the predetermined standard DEF concentration, or that some other major after-treatment fault has occurred (such as, NOx sensor failure, faulty DEF tank level sensor (tank out of DEF), DEF Injector failure, or SCR catalyst failure). It is noted that the other major after-treatment faults can often be confirmed or eliminated as causes for excessive NOx levels by other indicators or sensor readings. When a DEF quality fault is detected, the DEF concentration may be too low as a result of an operator watering down the DEF supply in an effort to reduce costs. When an unacceptable DEF quality is detected in this manner, controller 16 sets a DEF quality fault code which may initiate a shutdown in the manner described below.

Controller 16 also monitors the NOx outlet signal from outlet NOx sensor 75 to determine the level of NOx at the output of SCR section 30. If this NOx outlet signal exceeds a predetermined threshold, then controller 16 sets a NOx out-of-limits fault code. The inducement shutdown command 54 for DEF quality is activated when the DEF quality fault code and the NOx out-of-limits fault code are both set as is further described below.

Figure 7:
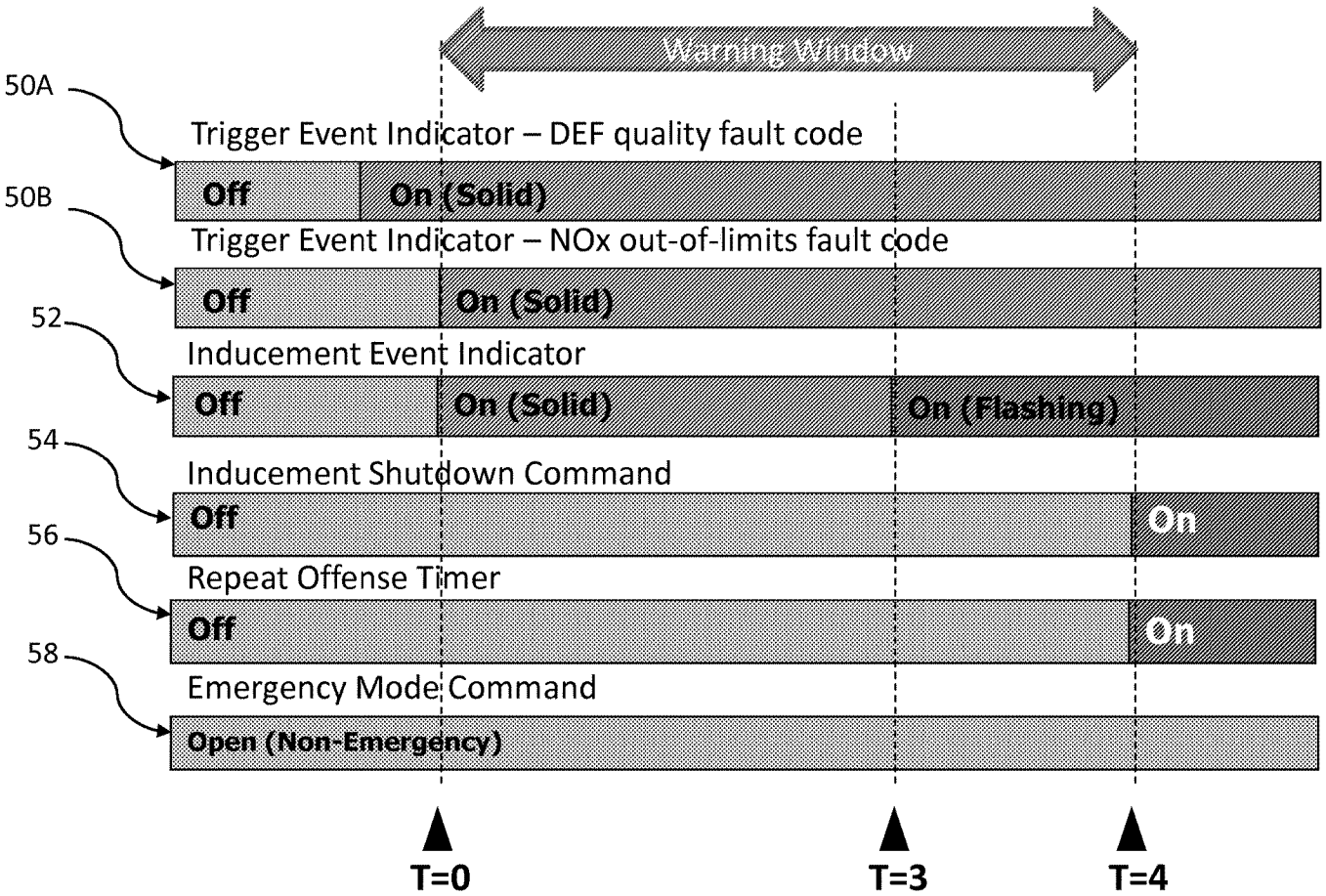
FIG. 7 is a timeline of a DEF quality inducement sequence according to the present disclosure.

Referring now to FIG. 7, in this example the DEF quality trigger event is considered. As shown, before time T=0 controller 16 sets a DEF quality fault code in response to determining that the dosing trim command from feedback controller 76 exceeds the predetermined threshold and that no other fault has occurred or caused the failure. As such, trigger event indicator 50A transitions from off to solid on indicating that an excessively high DEF trim dose is required to maintain the outlet NOx level below the acceptable level. At time T=0, controller 16 receives a NOx outlet signal from outlet NOx sensor 75 indicating that the NOx outlet level has exceeded the acceptable level. In response, controller 16 sets the NOx out-of-limits fault code and trigger event indicator 50B transitions from off to solid on. Additionally, controller 16 also transitions inducement event indicator 52 from off to solid on because both the DEF quality fault code and the NOx out-of-limits fault code are set at the same time. At time T=3 inducement event indicator 52 is transitioned to flashing if one or both of the DEF quality fault code and the NOx out-of-limits fault code are not corrected by the operator. If neither fault code is addressed, then at time T=4 controller 16 initiates inducement shutdown command 54 and begins repeat offense timer 56 in the manner described above.

As indicated above, system 10 also includes an inducement sequence to address tampering with system 10. In particular, controller 16 implements a primary tampering inducement sequence in response to detected tampering with DEF level sensor 60 or outlet NOx sensor 75. Controller 16 is in continuous communication with these sensors and is programmed to expect output signals having certain characteristics and/or falling within a particular range (e.g., voltage, frequency, etc.). When an output signal from one of these sensors is not present, does not have the expected characteristics, and/or falls outside the expected range, controller 16 interprets the condition as a tampering or failure event. Controller 16 also implements a secondary inducement sequence in response to detected tampering or failure of other individual sensors and/or components, but only if the NOx out-of-limits fault code is also set as is further described below. The other sensors and/or components that are monitored by controller 16 for expected output signals include, for example, pressure sensors, temperature sensors, NOx inlet sensor 71, communication components, pump 18 components, and DEF injector 24 components.

Figure 8:
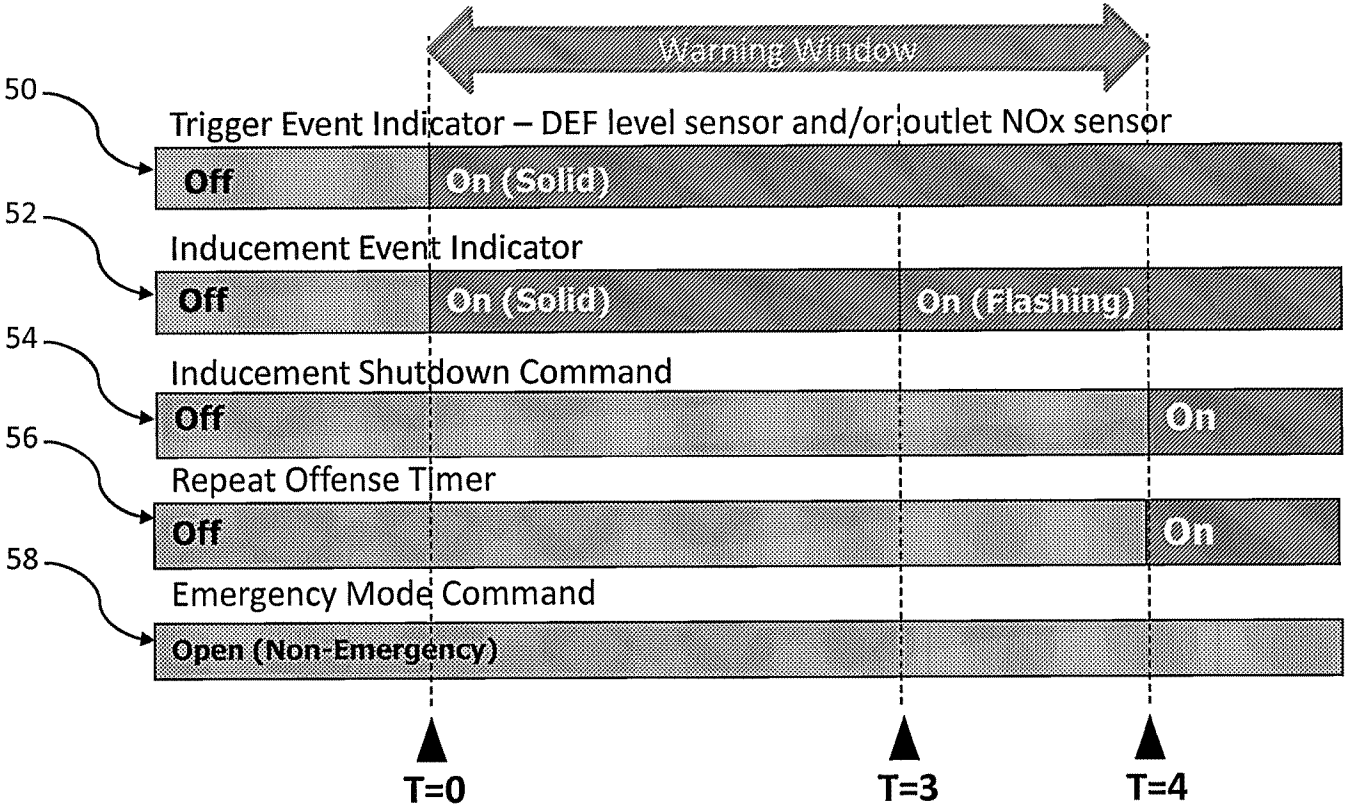
FIG. 8 is a timeline of a primary tampering inducement sequence according to the present disclosure.

With regard to the primary tampering inducement sequence depicted in FIG. 8, before time T=0 controller 16 has not detected either primary tampering event (i.e., DEF level sensor 60 tampering or outlet NOx sensor 75 tampering where the NOx output levels would be immediately affected). At time T=0, controller 16 detects one or both of these two events, and transitions trigger event indicator 50 from off to solid on. At the same time, controller 16 transitions inducement event indicator 52 from off to solid on. If, at time T=3, the tampering event(s) is/are not addressed by the operator, then controller 16 transitions inducement event indicator 52 from solid on to flashing, thereby indicating to the operator that an inducement shutdown command 54 is imminent. If at time T=4 the tampering event(s) is/are not addressed, then controller 16 initiates inducement shutdown command 54 and begins repeat offense timer 56 in the manner described above.

Figure 9:
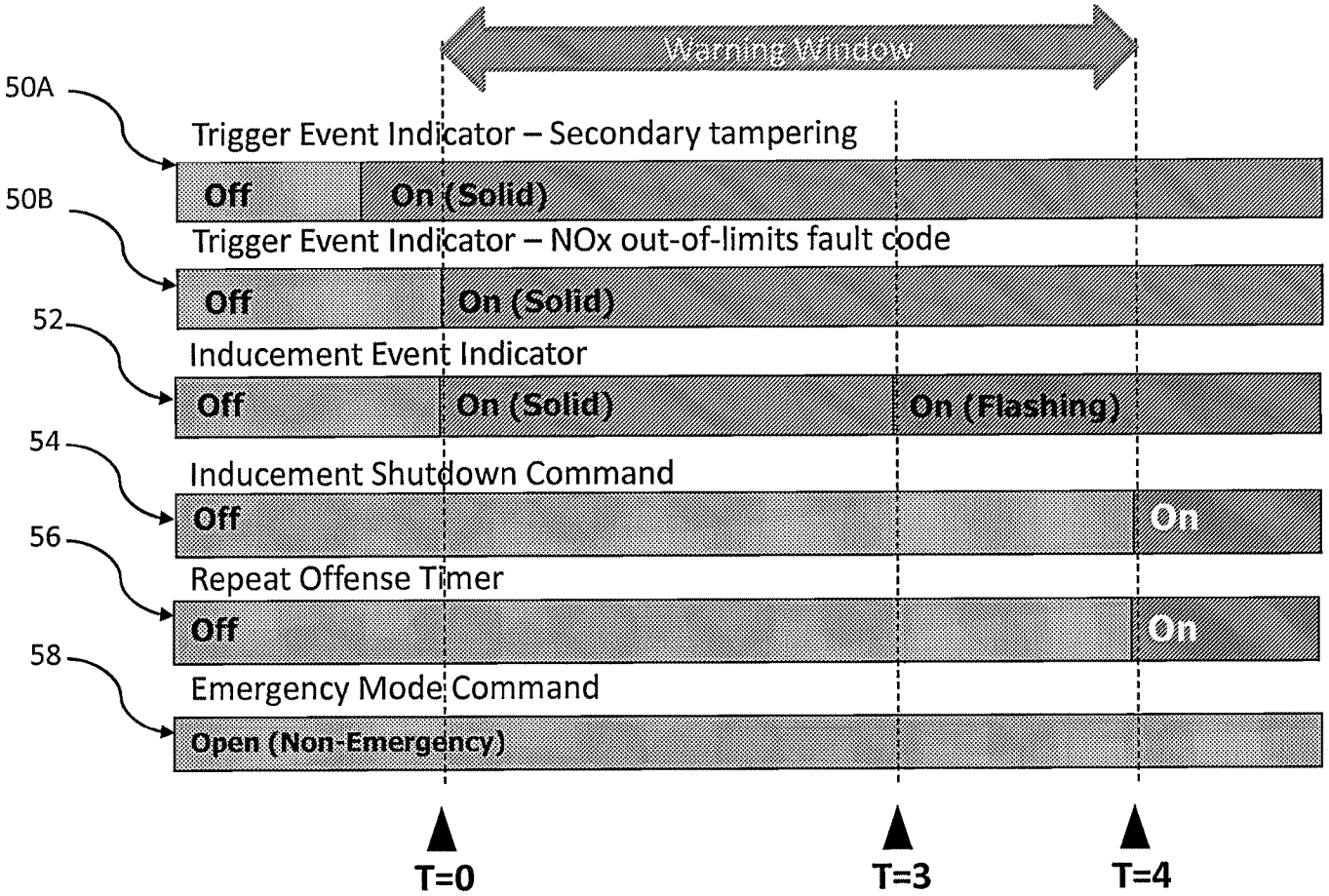
FIG. 9 is a timeline of a secondary tampering inducement sequence according to the present disclosure.

FIG. 9 depicts a secondary tampering inducement sequence according to the present disclosure. As shown, before time T=0 controller 16 sets a fault code in response to detecting tampering with any one or more of the various other sensors and/or components described above, where NOx levels would not necessarily yet be out of specified ranges upon detection. As such, trigger event indicator 50A transitions from off to solid on. As shown, the secondary tampering trigger event alone does not cause controller 16 to activate inducement event indicator 52. In this example, at time T=0 controller 16 also receives a NOx outlet signal from outlet NOx sensor 75 indicating that the NOx outlet level has exceeded the acceptable level. In response, controller 16 sets the NOx out-of-limits fault code and transitions trigger event indicator 50B from off to solid on. Additionally, controller 16 transitions inducement event indicator 52 from off to solid on. At time T=3, controller 16 transitions inducement event indicator 52 from solid on to flashing if one or both of the fault codes are not corrected by the operator. If neither fault code is addressed, then at time T=4 controller 16 initiates inducement shutdown command 54 and begins repeat offense timer 56 in the manner described above. Examples of secondary inducement tampering fault codes include, but are not limited to simultaneous failure of temperature sensors at the inlet and outlet of SCR portion 30, low DEF pressure at DEF injector assembly 24, injector failure, and DEF failure to pump 18. It should be understood, however, that in some embodiments, the simultaneous presence of two or more fault codes, along with the NOx out-of-limits fault code, can cause a secondary inducement. These fault codes include, but are not limited to, SCR inlet temperature sensor failure, SCR outlet temperature sensor failure, ambient temperature sensor failure, inlet pressure sensor failure, outlet pressure sensor failure, and inlet NOx sensor failure.

Figure 10:
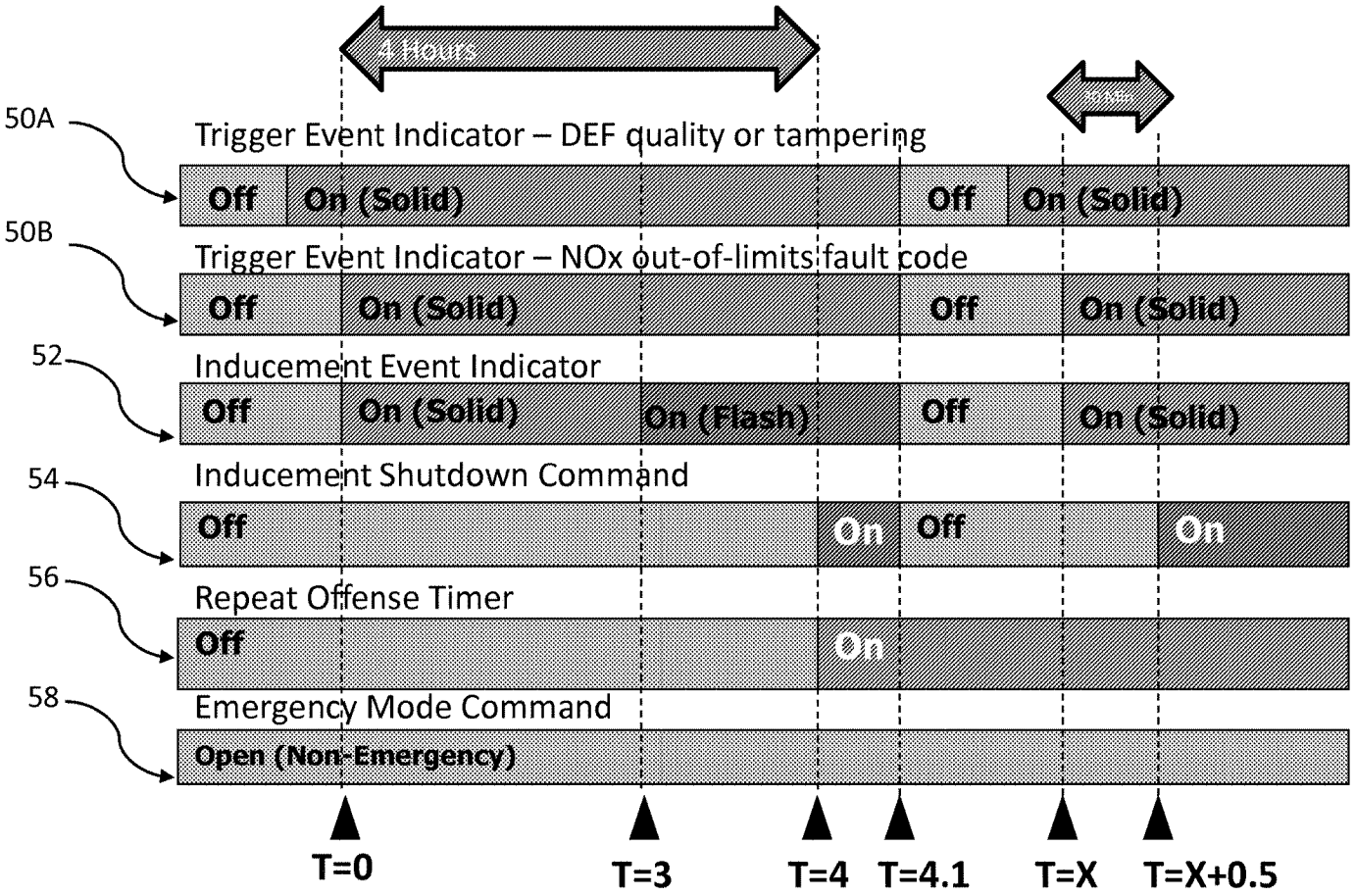
FIG. 10 is a timeline of a repeat offense inducement sequence according to the present disclosure.

FIG. 10 depicts a repeat offense inducement sequence that may occur in response to a repeat of a particular fault code category within a predetermined time period. In general, if the same fault or fault category recurs within a particular time period, then controller 16 utilizes the repeat offense inducement sequence and provides a shorter warning window to the operator before initiating an engine shutdown. If the inducement fault is in a differing fault category (or in an alternative embodiment, simply a different fault), it does not trigger the repeat offense inducement sequence. The only repeat fault that does not trigger this shorter warning window in a repeat offense situation is the DEF level fault. In the example of FIG. 10, before time T=0 one of above-described faults cause controller 16 to transition trigger event indicator 50A from off to solid on. In this example, the detected fault was not a primary fault, such as detecting tampering with DEF level sensor 60 or outlet NOx sensor 75, because these primary faults would cause controller 16 to activate inducement event indicator 52 directly.

At time T=0, controller 16 also sets a NOx out-of-limits fault code in response to detecting unacceptable levels of outlet NOx in the manner described above. As both a DEF quality/tampering fault is set and a NOx out-of-limits fault is set, controller 16 transitions trigger event indicator 50B from off to solid on. Additionally, inducement event indicator 52 is transitioned from off to solid on. As described above with reference to the other inducement sequences, if one or both of the active fault codes is not addressed by time T=3, then controller 16 transitions inducement event indicator 52 from solid on to flashing. If the fault codes have not been cleared by time T=4, then controller 16 initiates inducement shutdown command 54 and begins repeat offense timer 56 in the manner described above.

In this example, both of the fault conditions are cleared at time T=4.1. As such, trigger event indicators 50A, 50B are transitioned from solid on to off, inducement event indicator 52 is transitioned from flashing to off, and inducement shutdown command 54 is again transitioned to off. At this point, system 10 is operating fault free, however, repeat offense timer 56 is still active and incrementing though a repeat offense window of, in one embodiment, forty hours. In one embodiment, repeat offense timer 56 is incremented only when the speed of engine 12 is greater than zero. As shown in the figure, just before time T=X, trigger event indicator 50A is again transitioned from off to solid on in response to another detected fault, which in this example is the same fault or is in the same fault category of the fault that caused activation of trigger event indicator 50A before time T=0. At time T=X, trigger event indicator 50B is also transitioned from off to solid on in response to detection of another NOx out-of-limits fault code. In other words, the same fault codes in this example that were present at time T=0 are also present at time T=X. As such, inducement event indicator 52 is again transitioned from off to solid on. The repeat of the same fault codes at time T=X begins a repeat offense shutdown window of, for example, thirty minutes. Because the recurrence of the same faults represents a repeat offense, in one embodiment the operator is not given as much time to address the faults as was initially provided by the four hour warning window between times T=0 and T=4. If the fault codes have not been cleared within the shortened repeat offense shutdown window, then at time T=X+0.5, controller 16 sets a repeat offense fault code, initiates inducement shutdown command 54 in the manner described above, and activates a remote shutdown output signal which is communicated to ECU 13.

Figure 11:
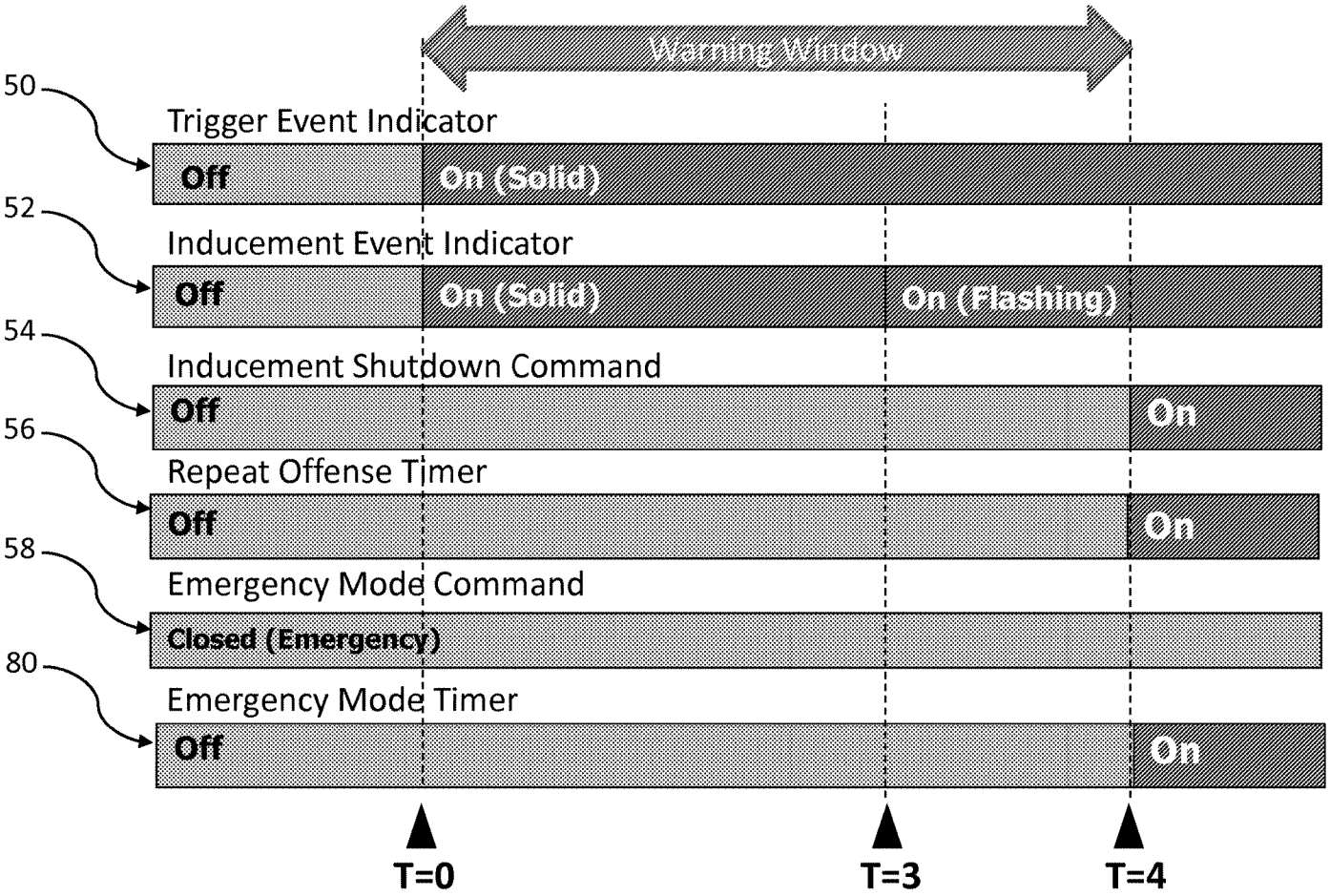
FIG. 11 is a timeline of an inducement sequence under an emergency operating mode according to the present disclosure.

Referring now to FIG. 11, the emergency operating mode of system 10 will be described. Controller 16 is configured to receive an emergency signal from, for example, ECU 13 which may receive a signal from a source such as an automatic transfer switch. An emergency signal indicates that engine 12 and generator 14 are operating in an emergency situation, and should not be shut down. For example, controller 16 may receive an emergency signal indicating that utility power is not available. In one embodiment, controller 16 will indicate the emergency mode of operation to the operator using one of the methods described above (e.g., indicator 40, audio alarm 42, an emergency message on display 38, or other mode of communication).

As shown in FIG. 11, the inducement sequence is essentially the same as that described above with reference to FIG. 8. Upon the occurrence of a fault condition at time T=0, controller 16 activates trigger event indicator 50 and inducement event indicator 52. As should be apparent from the foregoing, the fault condition causing activation of trigger event indicator 50 in this example must be a primary fault, such as a DEF level sensor 60 tampering fault or an outlet NOx sensor 75 tampering fault, because those faults cause immediate activation of inducement event indicator 52 without requiring the presence of a NOx out-of-limits fault. At the end of the warning window (i.e., at T=4), controller 16 initiates an inducement shutdown command 54. In this example, however, an emergency operation mode command 58 is present, overriding the inducement shutdown command 54 and allowing the genset to continue operation in emergency or other critical operation situations. Accordingly, inducement shutdown command 54 will not result in shut down of engine 12. Instead, controller 16 will initiate a warning indication (in one of the ways described above) that a shutdown would have been initiated if an emergency mode command 58 were not present. Controller 16 also sets an inducement shutdown fault code and, at time T=4 activates an emergency mode timer 80. Emergency mode timer 80 is activated to log the cumulative time system 10 is operated in an emergency mode. Timer 80 is incremented, in one embodiment, wherever the speed of engine 12 is greater than zero, the inducement shutdown fault code is active, and the emergency mode command 58 is present. The total emergency operating time is also maintained by controller 16 in memory 33 for auditing purposes.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A method of operating an exhaust after-treatment system, including:

monitoring the system to detect a first fault condition representing one of a DEF level fault, a DEF quality fault, and a tampering fault;

indicating the presence of the first fault condition in response to detecting the first fault condition;

indicating that a shutdown sequence will be performed if the first fault condition is not addressed within a first time period;

performing the shutdown sequence in response to the first fault condition not being addressed within the first time period; and monitoring the system to detect the first fault condition for a second time during a second time period.

2. The method of claim 1 wherein indicating that a shutdown sequence will be performed includes providing a first indicium during an initial portion of the first time period and a second, different indicium during a last portion of the first time period.

3. The method of claim 1 wherein monitoring the system to detect a first fault condition includes monitoring signals from a level sensor positioned in a DEF tank the signals indicating a level of DEF in the DEF tank.

4. The method of claim 3 wherein the first fault condition is a DEF level fault indicated by a signal from the level sensor representing a first level of DEF in the DEF tank; and wherein upon detection of the first fault condition for a second time during the second time period, indicating that a shutdown sequence will be performed if the first fault condition is not addressed within a second time period.

5. The method of claim 3 wherein the first time period corresponds to an estimated time for the level of DEF in the DEF tank to fall from a first position to a second position.

6. The method of claim 1, wherein the first fault condition is a primary tampering inducement fault selected from one or more of a DEF level sensor failure and an outlet NOx sensor failure.

7. The method of claim 1, wherein the first fault condition is a secondary tampering inducement fault selected from one or more of simultaneous failure of SCR inlet and outlet temperature sensors, low DEF pressure, injector failure, DEF pump failure, ambient temperature sensor failure, inlet pressure sensor failure, outlet pressure sensor failure, and inlet NOx sensor failure.

8. The method of claim 7, wherein one or more first fault conditions are fault categories, each category containing one or more secondary tampering inducement faults.

9. The method of claim 1, wherein monitoring the system to detect a first fault condition includes monitoring a dosing trim command used to adjust a quantity of DEF injected into exhaust and a NOx sensor output signal indicating a level of NOx present in an exhaust outlet from the system.

10. The method of claim 1, wherein the first fault condition is a DEF quality fault caused by an increase in the dosing trim command beyond a threshold.

11. The method of claim 1 wherein monitoring the system to detect a first fault condition includes monitoring a DEF quality sensor to sense the quality of DEF being injected into exhaust; and wherein the first fault condition is a DEF quality fault indicated by the DEF quality sensor caused by the quality of the DEF decreasing beyond a threshold.

12. The method of claim 1 further including monitoring the status of an emergency mode command, wherein performing the shutdown occurs only when the first fault condition is not addressed within the first time period and the status of the emergency mode command indicates a non-emergency operating condition.

13. The method of claim 1 wherein the first fault condition is a tampering fault indicated by a characteristic of a signal from one of a DEF level sensor and an outlet NOx sensor.

14. An SCR exhaust after-treatment system, including:

a level sensor positioned in a DEF tank, the level sensor providing level signals indicating a level of DEF in the tank; and a controller coupled to the level sensor to receive the level signals, the controller including an inducement event indicator;

wherein the controller responds to receipt of a first level signal from the level sensor representing a first level of DEF in the tank by activating the inducement event indicator to provide a first indicium of an impending engine shutdown; and wherein the controller responds to receipt of a second level signal from the level sensor representing a second level of DEF in the tank, the second level being lower than the first level, by activating the inducement event indicator to provide a second indicium of an impending engine shutdown, the second indicium being different from the first indicium.

15. The system of claim 14 wherein the controller responds to receipt of a third level signal from the level sensor representing a third level of DEF in the tank, the third level being lower than the second level, by transmitting a shutdown command to an ECU which causes the ECU to shut down an engine.

16. The system of claim 14 wherein the controller responds to receipt of an output signal from an exhaust outlet NOx sensor positioned in an outlet of the system representing a level of NOx that is out-of-limits, by transmitting a shutdown command to an ECU which causes the ECU to shut down an engine.

17. An SCR exhaust after-treatment system, including:

an inlet NOx sensor in communication with an inlet exhaust stream, the inlet NOx sensor generating an inlet NOx signal indicating a level of inlet NOx in the inlet exhaust stream;

a DEF injector assembly in communication with the inlet exhaust stream, the DEF injector assembly including a nozzle configured to inject DEF into the inlet exhaust stream thereby creating a dosed exhaust stream;

an SCR portion having a catalyst that converts the dosed exhaust stream into an outlet exhaust stream having reduced NOx;

an outlet NOx sensor in communication with the outlet exhaust stream, the outlet NOx sensor generating an outlet NOx signal indicating a level of outlet NOx in the outlet exhaust stream; and a controller coupled to the inlet NOx sensor to receive the inlet NOx signals and the outlet NOx sensor to receive the outlet NOx signals;

wherein the controller is programmed to provide a final dosing command to the DEF injector assembly to control injection of DEF into the inlet exhaust stream, the final dosing command including an initial dosing command in response to the inlet NOx signal and a dosing trim command in response to the outlet NOx signal; and wherein the controller is programmed to set a DEF quality fault in response to the dosing trim command exceeding a predetermined threshold.

18. The system of claim 17 wherein the controller is further programmed to activate an engine shutdown sequence if the DEF quality fault is not cleared within a first time period.

19. The system of claim 18 wherein the controller is further programmed to activate an engine shutdown sequence if the DEF quality fault is cleared within the first time period, but reoccurs within a second time period.

20. An SCR exhaust after-treatment system, including:

a level sensor configured to provide output signals representing a level of DEF within a tank;

a NOx sensor configured to provide output signals representing a level of NOx in exhaust at an outlet of the system; and a controller coupled to the level sensor and the NOx sensor to receive the output signals;

wherein the controller is programmed to respond to receipt of an output signal not having an expected characteristic by setting a tampering fault indicating that one of the level sensor and NOx sensor has been tampered with and activating a timer to begin incrementing through a first time period; and wherein the controller is further programmed to activate an engine shutdown sequence if the tampering fault is not cleared during the first time period.

21. The system of claim 20 wherein the controller is further programmed to, upon activating the engine shutdown sequence, activate a repeat offense timer to begin incrementing through a second time period, respond to an occurrence, after the first time period but during the second time period, of an output signal not having an expected characteristic by resetting the tampering fault and reactivating the timer to begin incrementing through a third time period which is less than the first time period.

22. The system of claim 21 wherein the controller is further programmed to activate an engine shutdown sequence if the reset tampering fault is not cleared during the third time period.

* * * * *